US012428041B2

(12) United States Patent
Beha

(10) Patent No.: US 12,428,041 B2
(45) Date of Patent: Sep. 30, 2025

(54) AERIAL CABLE TRANSPORTATION SYSTEM AND METHOD FOR OPERATING SUCH A SYSTEM

(71) Applicant: LEITNER S.P.A., Vipiteno (IT)

(72) Inventor: Rudolf Beha, Vipiteno (IT)

(73) Assignee: LEITNER S.P.A., Vipiteno (IT)

( * ) Notice: Subject to any disclaimer, the term of this patent is extended or adjusted under 35 U.S.C. 154(b) by 763 days.

(21) Appl. No.: 17/851,831

(22) Filed: Jun. 28, 2022

(65) Prior Publication Data

US 2022/0410943 A1 Dec. 29, 2022

(30) Foreign Application Priority Data

Jun. 29, 2021 (IT) ..... 102021000017027

(51) Int. Cl.
*B61B 12/06* (2006.01)
*B61B 7/00* (2006.01)
(Continued)

(52) U.S. Cl.
CPC ..... *B61B 12/06* (2013.01); *B61B 7/00* (2013.01); *B61B 7/04* (2013.01); *B61B 11/00* (2013.01);
(Continued)

(58) Field of Classification Search
CPC ..... B61B 12/06; B61B 12/022; B61B 12/024; B61B 12/026; B61B 7/00; B61B 7/04; B61B 11/00; B61L 23/04; B61L 2201/00
(Continued)

(56) References Cited

U.S. PATENT DOCUMENTS 5,528,219 A * 6/1996 Frohlich ..... B61B 12/06 340/521
9,989,087 B2 * 6/2018 Bacher ..... B61B 7/02
(Continued)

FOREIGN PATENT DOCUMENTS

CN 106053591 A * 10/2016 ..... G01M 99/00
DE 102007006316 B3 * 4/2008 ..... B61B 12/06
(Continued)

OTHER PUBLICATIONS

Italian Search Report and Written Opinion for Application No. IT202100017027 dated Mar. 4, 2022.

*Primary Examiner* — S. Joseph Morano
*Assistant Examiner* — James William Jones
(74) *Attorney, Agent, or Firm* — Neal, Gerber & Eisenberg LLP

(57) ABSTRACT

An aerial cable transportation system comprising: at least one hauling cable; a first fixed structure; at least one transportation unit; a plurality of sensors configured for detecting the passage of the transportation units; a control unit; wherein the plurality of sensors comprises at least a first sensor arranged at the exit area of the first fixed structure and at least a second sensor downstream of the first sensor, respectively, at is least a distance s1 from the first sensor measured in cable-meters; wherein the control unit is connected to the sensors and is configured for: upon the passage of each transportation unit at the first sensor, starting to count the meters of cable fed outside the first fixed structure; when the counting of the meters of cable fed outside the first fixed structure reaches amounts about equal to the at least one distance s1, autonomously activating safety procedures if the passage of the transportation unit is not detected by each corresponding second sensor downstream of the first sensor.

17 Claims, 5 Drawing Sheets

(51) Int. Cl.

| | |
|---|---|
| ***B61B 7/04*** | (2006.01) |
| ***B61B 11/00*** | (2006.01) |
| ***B61B 12/02*** | (2006.01) |
| ***B61L 23/04*** | (2006.01) |

(52) U.S. Cl.
CPC ..... *B61B 12/022* (2013.01); *B61B 12/024* (2013.01); *B61B 12/026* (2013.01); *B61L 23/04* (2013.01); *B61L 2201/00* (2013.01)

(58) Field of Classification Search
USPC ..... 104/173.1, 173.2
See application file for complete search history.

(56) References Cited

U.S. PATENT DOCUMENTS

| | | | | |
|---|---|---|---|---|
| 10,370,007 | B2 * | 8/2019 | Graf | G01N 27/82 |
| 10,494,004 | B2 * | 12/2019 | Yano | B61L 23/04 |
| 2016/0046305 | A1 * | 2/2016 | Cylvick | B61L 21/10 701/19 |
| 2019/0193755 | A1 * | 6/2019 | Conte | B61B 12/125 |

FOREIGN PATENT DOCUMENTS

| | | | | |
|---|---|---|---|---|
| EP | 1 837 264 | A2 | 9/2007 | |
| EP | 1997706 | A1 * | 12/2008 | B61B 12/022 |
| EP | 2 101 237 | A1 | 9/2009 | |
| EP | 2101237 | A2 * | 9/2009 | H04L 67/12 |
| EP | 3009321 | A1 * | 4/2016 | A63G 21/22 |
| EP | 3 686 075 | A1 | 7/2020 | |
| FR | 2941206 | A1 * | 7/2010 | B61B 12/105 |
| WO | WO 95/30216 | A1 | 11/1995 | |
| WO | WO 2020/182791 | A1 | 9/2020 | |

* cited by examiner

AERIAL CABLE TRANSPORTATION SYSTEM AND METHOD FOR OPERATING SUCH A SYSTEM

PRIORITY CLAIM

This application claims the benefit of and priority to Italian Patent Application No. 102021000017027, filed on Jun. 29, 2021, the entire contents of which is incorporated herein by reference.

TECHNICAL FIELD

The technical field of the present disclosure relates to aerial cable transportation systems (i.e., systems in which passengers and/or loads are transported along a predefined path by transportation units moved and supported in succession one after the other by at least one cable). In these systems, the path is usually bounded at the ends by terminal stations where passengers can embark and disembark from the transportation units. Between the terminal stations, these systems usually comprise intermediate structures which can be intermediate embarking and disembarking stations or intermediate structures for supporting the cable, generally in the form of pylons or towers. In this technical context, the present disclosure will address the issue of how to increase passenger safety. More specifically, the present disclosure will address the issue of how to improve the checking, understood as the continuous monitoring, of the advance of the transportation units travelling between the terminal stations.

BACKGROUND

Aerial cable transportation systems in which passengers are transported along a predefined path by suitable transportation units fed one after the other between two terminal stations, also known as the upstream and downstream stations, located at the ends of the system and in which passengers safely embark and disembark, are known. In particular, the term "aerial" refers to cable systems in which the transportation units are moved supported by at least one cable (i.e., the supporting cable), raised above the ground below, or above other possible fixed structures below.

An aerial cable transportation system is relatively very useful when the conformation of the ground below, or other surrounding factors, do not make advance on the ground feasible. For example, aerial cable systems are used in the case where the path to be travelled has major elevation changes, possibly with considerable slopes. This path is typical of ski/mountain areas and in this context these systems are also called uphill lift systems. However, the present disclosure and aerial cable systems in general also find advantageous application in urban contexts where land transport is congested. It is often also necessary to provide intermediate fixed structures along the path between the terminal stations, configured to support the cable. One reason for requiring such intermediate fixed structures may be the excessive distance between the terminal stations such as not to allow the cable to be arranged in a single span. Another reason may be the elevation profile of the path of the system in the event of significant slope changes. Each intermediate fixed structure for supporting the cable usually comprises a vertical support structure, such as for example a pylon or a tower, providing, on the top, cable support and guide devices, for example a head with a series of rollers. These rollers can be arranged along a single row (known as a support or retention roller conveyor) or along two superimposed rows between which the cable is made to slide (double-acting roller conveyor). In particular, these rows of rollers are installed on the top of the pylons by suitable fixed bracket structures (also known as support heads) constrained to the pylons. This bracket structure forms, together with the corresponding pylon, a substantially T-shaped fixed structure. Two parallel support heads can be provided to support the forward and return branches of the cable. These bracket structures or support heads are also configured to enable periodic inspection and servicing of the rollers and for this purpose are equipped with appropriate platforms (protected with rails) for the walking of the service staff. If there is at least one supporting cable (two-cable or three-cable systems), the latter is always supported at the head of the pylons in a suitable structure (i.e., a saddle). At this saddle, the roller which usually rolls on the supporting cable rolls on the outer profiles of said saddle.

Safety in aerial cable systems is a very important parameter. As such, many specific rules impose certain standards by law on the manufacturers and systems are designed and provided with new solutions aimed at increasing passenger safety. To this end, the section of the path between the terminal stations represents the part of the transport which requires the most attention. For example, the regulations in force prescribe a minimum safety transverse distance that must be present between the pylons and the transportation units. As such, it is necessary to take into account that the transportation units can tilt due to the presence of lateral wind (i.e., perform rolling movements around the axis defined by the cable or directly advance in a tilted configuration). The maximum permissible tilt of the vehicles is therefore one of the parameters for designing a cable system. Upon reaching and exceeding the critical wind speed, at which the transportation units tilt beyond a certain limit angle with respect to the vertical of gravity, it is necessary to implement safety measures such as reducing the forward speed or stopping the system. For example, EP Patent No. 1837264 describes a cable transportation system provided with appropriate sensors for monitoring the tilt of the transportation unit and consequently controlling the operation of the system.

In this scenario, however, it must also be taken into account that the wind speed can also change relatively very quickly (the so-called "gusts"). In this case, the contact of the transportation units with the movable or fixed parts of the intermediate fixed structures (in particular, with the platforms or brackets supporting the rollers or the fixed structures supporting the cables) cannot be excluded because of the lack of physical time required to slow down or stop the system or because of the need to continue the operation to put the transportation units into storage (which operation lasts for a time in the order of 30 minutes or more). The transportation unit coming into contact with the intermediate fixed structure can also be hooked or blocked by the structure itself, and in such conditions, the transportation unit may fall to the ground, or the hauling cable may slip in the clamp (this is specifically permitted by law), resulting in the damage of the cable itself. Furthermore, in such conditions, other transportation units can bump into the blocked one, creating a situation of relative extreme danger.

Therefore, in cable transportation systems, there is the need not only to monitor the tilt of the moving transportation units but also to generally check the progress of the units outside the terminal stations to have immediate feedback of any transportation units blocked along the path at the intermediate support structures arranged along the route.

PCT Patent Application No. WO2020182791 describes a solution to the problem of having immediate confirmation of a blockage of a transportation unit during transit near a pylon. According to PCT Patent Application No. WO2020182791, each pylon is equipped with an entry sensor detecting the entry of the transportation unit into the pylon and an exit sensor detecting the exit of the transportation unit away from the pylon. These sensors are connected to a control unit so that when a transportation unit passes by the entry sensor, the numerical counter (initially set to zero) is increased by one numerical unit. When a transportation unit passes by the exit sensor, the counter is reduced by one numerical unit. Therefore, the current value of the counter identifies the number of transportation units occurring between the sensors along the pylon. An alarm will sound if this numerical value exceeds a certain threshold.

However, the above solution has some drawbacks. For example, the solution described in PCT Patent Application No. WO2020182791 is not able to check and signal any malfunctions that occur along the route between the pylons. For example, due to the falling of a tree on the cable, it may happen that the clamp is unable to get past this obstacle and therefore that the transportation unit is blocked (with the cable running) along the route outside the stations in a position between two pylons or in general upstream of a pylon. In this case, in the absence of units entering the pylon, the counter described in WO2020182791 would not be increased, would never exceed the critical threshold value and would therefore not be able to promptly signal the dangerous situation created.

SUMMARY

Starting from this prior art, one object of the present disclosure is to provide a aerial cable transportation system which can overcome certain of the above-mentioned drawbacks of certain of the prior art. In particular, it is an object of the present disclosure to provide an aerial cable transportation system in which any blocking or slowing down of a transportation unit along the external path of the station can be identified and signalled. The route under control according to the present disclosure comprises both the portions along any intermediate fixed structures between the terminal stations and any external section between the terminal stations (i.e., both between the terminal stations and the proximal intermediate fixed structures and between adjacent intermediate fixed structures).

It should be appreciated that the present disclosure relates both to aerial cable transportation systems of the "single-cable" type, in which the supporting cable also acts as the hauling cable, and transportation systems with a dual supporting-hauling cable, or of the "two-cable" and "three-cable" type, in which one or two supporting cables, respectively, are present in addition to the hauling cable. Systems having two supporting cables and in which the advance is not generated by a hauling cable but by a motorized trolley supported by the cables are also envisioned. Where present, the hauling cable is looped and moved between the terminal stations, and in the case of single-cable systems, the transportation units comprise suitable devices (for example, clamps) so that they remain constrained to the cable at least in the section outside the stations. In the station, the transportation units are released from the hauling cable and proceed at a relatively lower speed, which is useful for relative safe embarkation and disembarkation, without slowing down the units moving along the rest of the route. If at least one supporting cable is present, the latter is substantially fixed (i.e., not moved between the stations except for periodic servicing and only subjected to limited movements due to change in the load conditions of the line) and the transportation units comprise further devices (e.g., roller trolleys) capable of sliding along the supporting cable. For convenience and unless otherwise specified, reference will be made to a single cable, understood as both a hauling and a supporting cable. In any case, the present disclosure is not limited to single-cable systems only and also extends to aerial cable systems with a dual supporting-hauling cable, of the two-cable or three-cable type, and with supporting cables only and motorized transportation units.

In various embodiments, the present disclosure provides a technical solution which can be integrated into an aerial cable transportation system comprising the following elements: at least one cable; a first fixed structure; at least one transportation unit; a plurality of sensors configured for detecting the passage of the transportation units; and a control unit connected to the sensors. The "at least one cable" feature indicates that the disclosure can be applied both in single-cable systems, in which a single cable carries out the hauling function and the supporting function, and in systems with several hauling cables, both in systems with more than one cable, in which there is one hauling cable and at least one supporting cable, and in systems with supporting cables only and motorized advancing trolleys. Aerial cable systems usually comprise fixed structures in the form of two terminal stations (i.e., passenger embarkation and disembarkation stations) located at the ends of the route. Fixed structures in the form of intermediate stations are also often provided. However, in general, the terminal stations and any intermediate stations have not been explicitly mentioned to emphasize that the present disclosure relates to checking/monitoring the advance of the transportation units along the whole route regardless of the types of structures present. The transportation units can be gondolas or chairs, or any other type suitable for passenger transport. Types of sensors configured to detect the passage of the transportation units includes, for example, capacitive sensors capable, for example, of interacting with and thus detecting the passage of the clamp constraining the transportation unit to the cable. Finally, a control unit connected to the sensors. Such a control unit may be the same already used in the system in which the new functions are inserted or may be one or more control units specifically dedicated to the implementation of the disclosure.

Having clarified these points, the plurality of sensors comprise at least two sensors, that is, at least a "first" sensor arranged at the exit area of the "first" fixed structure and at least a "second" sensor downstream of the first sensor at a corresponding known distance s1 s2 sn defined in cable-meters from the first sensor. "Exit area of the first fixed structure" is intended to mean the end section of the same beyond which the unit travels suspended in the air towards another fixed structure. The distance defined in cable-meters means the distance not calculated as the minimum space between two points, but the length measured along the axis of the hauling cable between two sensors. From a structural or mechanical point of view, the first and second sensors may also show no differences and may be the same or even be a single double-acting sensor. As such, a distinction between the first and the second sensor is how the control unit processes any signals detected therefrom. The first sensor is the starting check point (and as set forth below, a system may also have multiple starting check points along the route), whereas the second sensors are check points or finishing lines to check whether the transportation units are actually advancing as desired. As previously described, the second sensors downstream of the first sensor are arranged along the remaining part of the route at known distances s1 s2 sn (cable-meters); which type of support they are constrained to is not particularly relevant for the purposes of the general definition of the present disclosure, which pertains to monitoring the transportation units along their path starting from the exit from the first fixed structure and not only at some intermediate sections or at specific structures. For example, a first sensor may be arranged in the exit area of a first terminal station and the second sensors downstream of the first sensor may be arranged along the head of a cable support pylon, at an intermediate station, in the entry area of a second terminal station or also at specific points along the cable itself. In another example, a first sensor may also be arranged in the exit area of an intermediate structure and the same sensor may also act as a second sensor for a monitoring section upstream of the system. As such, one aspect of the present disclosure is checking the progress of the units along the system downstream of the first fixed structure(s). In this respect, an element in structural terms is the presence of a control unit, which is configured to receive from the first sensor the information that a transportation unit is leaving the fixed structure and at that point initiates the checking steps.

According to a first example, in that circumstance the control unit activates a counter to measure the meters of hauling cable fed outside the fixed structure. In this example, when the counter reaches a value of meters of cable delivered about equal to the distances s1 s2 sn, the control unit expects to receive from the second sensors an indication of the passage of the transportation unit. As such, there are two scenarios generally available. In the first scenario, the transportation unit actually passes by the second sensors when the meters of cable delivered are about equal to the distances s1 s2 sn and therefore the unit is secured to the cable and is proceeding in line with the theoretical timetable. "About equal" is intended to mean that the passage detected within a predetermined range of meters of cable delivered, with the distances s1 s2 sn as the centre of the range, is accepted as a good outcome. The second scenario contemplates that the unit does not reach the intermediate finish line or check point (where the second sensor is located) even if a quantity of meters of cable equal to the distances s1 s2 sn has actually been delivered from the fixed structure. Unfortunately, this means that something has happened which has compromised the natural coupling between the transportation unit and the hauling cable. In this condition, the control unit is configured to autonomously activate safety procedures and also optionally to emit an alarm signal and to indicate which is the sensor where the unit has not arrived as expected. In this condition, the operator in the station can also adequately intervene on the system and check the section between the signalled sensor and the one upstream thereof (the section where something has happened which has slowed down or blocked the advance of the unit with respect to the hauling cable). Generally, therefore, if the passage of the transportation unit at each second sensor downstream of the first sensor is not detected as expected, within a predetermined range between the actual meters of cable delivered and the distances s1, s2 sn, the control unit autonomously performs some safety procedures aimed at protecting the safety of the passengers. Reasons for delay with respect to the theoretical timetable or reasons for the blocking or slowing down of the unit with respect to the hauling cable may be, as indicated above, an undesired block at the pylon due to strong lateral or longitudinal wind which may cause undesired oscillations, or the falling of a tree on the cable.

The above has been centered on the measurement of the meters of cable delivered as a parameter for comparison with the known distances s1 s2 sn because the progression of the hauling cable exiting the station is a parameter already available, controlled, and immediate, without the need for differentiation calculations. Additionally or alternatively, instead of in terms of distances, it is possible to utilize terms of theoretical split times for reaching the sensors, this because the distance s1 s2 sn between the second sensors and the first sensor, as well as the theoretical speed of the transportation units (equal to the speed of the hauling cable) are known. In terms of time intervals, the present disclosure can also be extended to systems not provided with a hauling cable but provided with supporting cables only and motorized units. In these cases, to carry out the disclosure, it is necessary to calculate theoretical split times at which the transportation unit should pass by the second sensors downstream of the first sensor. In other words, if the control unit receives the indication of the exit of the unit at time t0, and based on data on the theoretical advance speed of the unit (speed of the cable or of the motorized trolley) and on the distance s1 s2 sn in terms of cable-meters between the sensors and the terminal sensor, it is able to calculate split times t1, t2, tn of the theoretical passage of the unit by the sensors.

As in the previous case, there are two general scenarios available at this point. In the first scenario, the transportation unit actually passes by the second sensors at the estimated split times t1, t2, tn and therefore in line with the calculated theoretical timetable. "At about the estimated time" is intended to mean that the passage is detected by the sensor and occurs at most with a delay or an advance within a set maximum limit threshold. In this respect, the various sensors send the information about the passage to the control unit, which checks whether the unit is actually too late or too early with respect to the calculated theoretical timetable (split times). If the unit reaches the intermediate finish line or check point (where the second sensor is located) too late or too early with respect to the calculated theoretical timetable (split times), or does not reach it at all, the control unit is configured to automatically intervene on the system appropriately. The section between the alarmed sensor and the one upstream thereof (the section where something has occurred that has slowed down or blocked the advance of the unit) can then be checked.

It should be appreciated that to increase safety, in certain embodiments, both logics are activated simultaneously (i.e., a double check based on the cable meters supplied with known distances s1 s2 sn and the theoretical split times t1 t2 tn with respect to the real times of arrival at the sensors).

In certain embodiments, the first fixed structure is a first terminal station which actually represents the starting point of the transportation unit's journey along the system. However, as already described above, this concept of "starting point" of the check can also be generalized and shifted to an intermediate position of the system by providing two or more starting points of the monitoring cycle. In this respect, a pylon can also act as a first fixed structure and the system is divided into two or more checked sub-systems (i.e., a first sub-system between the first terminal station (with a first sensor) and said pylon, and at least a second sub-system between said pylon and the second terminal station or another pylon). This possibility of providing several "first structures" is advantageous for relatively long-distance systems in which natural accumulated tolerances can increase precisely in view of the relatively long distance.

Considering the method of operation of the system, the method can be summarized as follows divided according to the two logics.

If the checking parameter is space, the steps will be:

detecting the exit of a transportation unit from the first fixed structure (which, as said, may be more than one), such as the first terminal station and/or an intermediate structure;

start measuring the meters of cable fed outside the first fixed structure; and upon the feeding outside the first fixed structure of a quantity of meters of cable about equal to the distances s1, s2, sn, autonomously activating safety procedures if the passage of the transportation unit is not detected by each corresponding second sensor downstream of the first sensor.

If the checking parameter is time, the steps will be:

detecting the exit of a transportation unit from the first fixed structure;

calculating theoretical split times t1 t2 to in which the transportation unit should pass by predetermined finish lines (second sensors) downstream of the first terminal station; and emitting an alarm signal if the transportation unit does not pass by the finish lines within a maximum delay threshold value with respect to the calculated theoretical split times.

It should be appreciated that these methods must be repeated for each travelling transportation unit, and as mentioned above, several starting check points can be provided along the path.

According to certain embodiments, the system comprises: a first terminal station; a second terminal station; and at least one intermediate structure between the terminal stations; wherein at least a first sensor or exit terminal sensor is arranged in the exit area of the first terminal station, at least a second entry terminal is arranged in the entry area of the second terminal station, and at least a second sensor, or intermediate sensor, is arranged at the at least one intermediate structure.

In certain embodiments, each intermediate structure comprises an entry area and an exit area for the transportation units. In this case, for each intermediate structure, a second (intermediate) sensor is provided only in the exit area of the intermediate structure, or a second (intermediate) entry sensor and a second (intermediate) exit sensor are provided in the entry area and in the exit area, respectively, of the intermediate structure.

As already described, an intermediate structure is, for example, an intermediate station and/or a pylon supporting the cable. However, as mentioned, a sensor can also be directly constrained along the cable by a suitable U-bolt, for example, in the absence of intermediate structures.

According to a more detailed embodiment, the terminal stations are U stations for providing two opposite directions of travel of the transportation units. Therefore, each terminal station comprises a second entry terminal sensor and a first exit terminal sensor and each intermediate structure comprises, for each direction of travel, a second (intermediate) entry sensor and a second (intermediate) exit sensor.

BRIEF DESCRIPTION OF THE DRAWINGS

Further features and advantages of the present disclosure will be apparent from the following description of a non-limiting embodiment thereof, with reference to the figures of the accompanying drawings, wherein.

DETAILED DESCRIPTION

Figure 1:
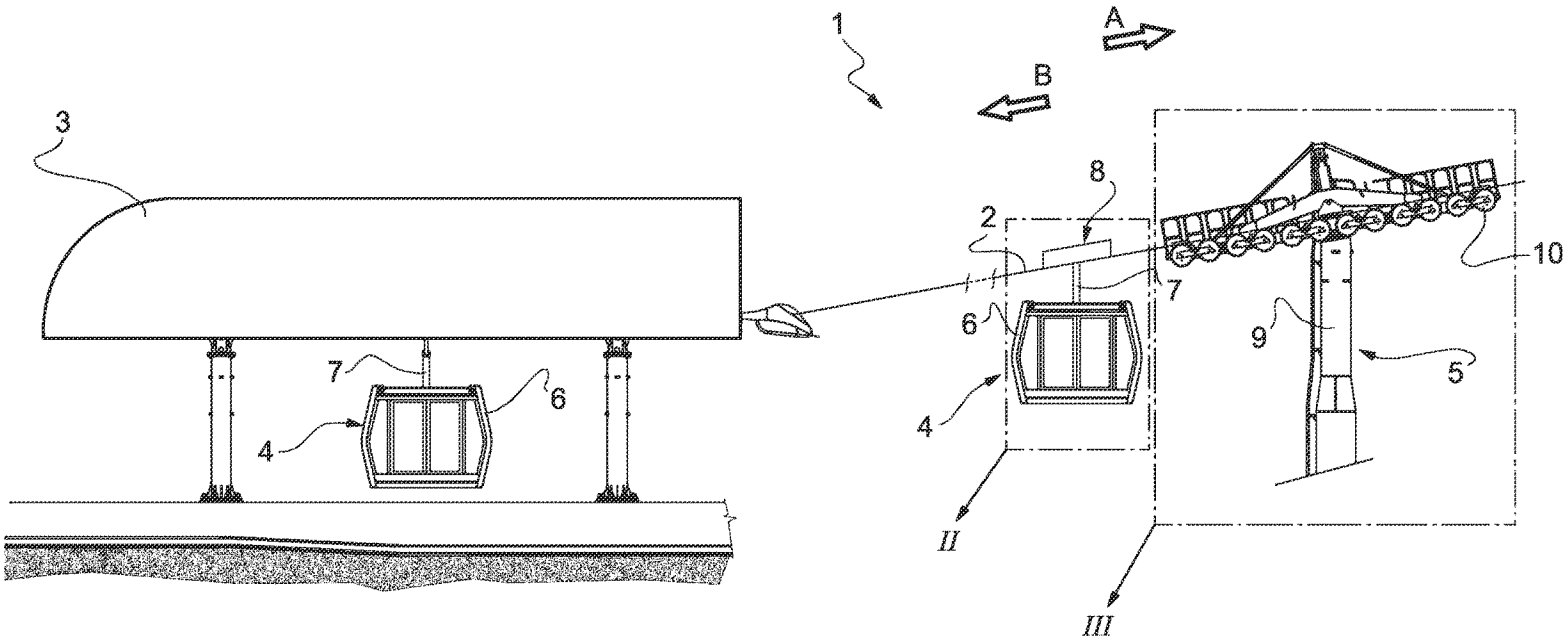
FIG. 1 is a schematic view of a portion of an aerial cable transportation system.
Figure 2:
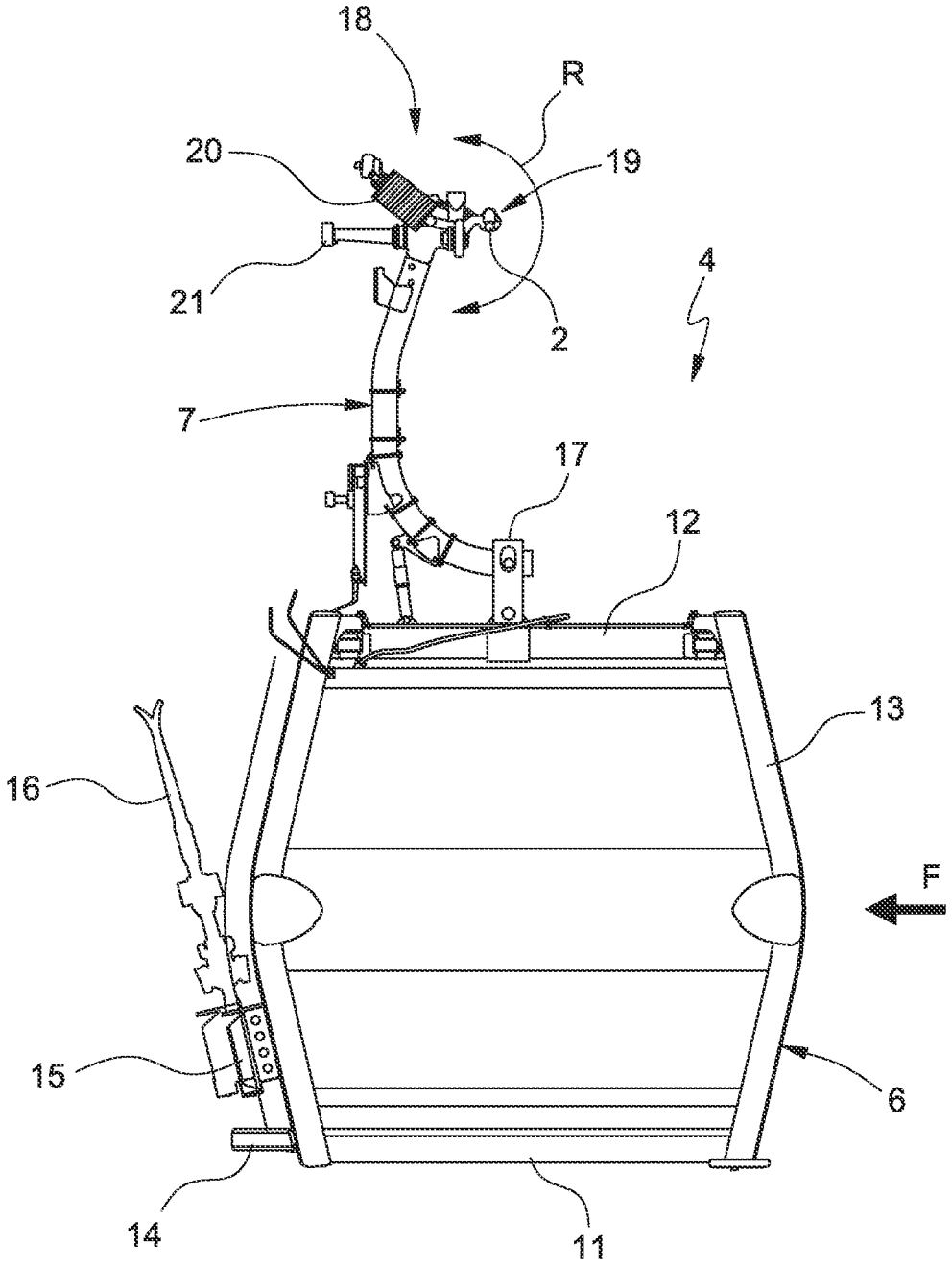
FIG. 2 is a schematic view of the component indicated as II in FIG. 1 (i.e., a transportation unit in the form of a gondola)

Therefore, with reference to the accompanying figures, FIG. 1 schematically shows a portion of an aerial cable transportation system indicated as a whole with the reference number 1. In particular, FIG. 1 shows an example of an aerial cable system in which the solution proposed by the present disclosure brings considerable advantages in terms of safety. In this non-limiting example, the aerial cable system 1 is of the single-cable type and therefore comprises a single cable 2 which acts both as a supporting cable and a hauling cable. Said cable 2 is looped by two pulleys—one of which is motorized—between two terminal stations, in particular a first terminal station or bottom station 3 and a second top terminal station (3' shown in FIG. 4A). Therefore, there are two parallel branches which identify an upward branch and a downward branch. The arrows A and B in FIG. 1 indicate precisely the directions of travel of the upward and downward branches of the cable 2. FIG. 1 shows one of the many transportation units 4 present in the system, which are arranged one after the other along both the upward and downward branches. In the representation of FIG. 1, a first transportation unit 4 is located at the bottom station 3, inside which the transportation units 4 are usually disengaged from the cable 2 to advance more slowly. This slowing down is advantageous to enable relatively easy embarkation and disembarkation of passengers without reducing the speed of travel of the line between stations. The second transportation unit 4 shown in FIG. 1 is travelling along the upward branch of the cable 2 and is located between the bottom station 3 and a first fixed intermediate support structure 5 (in the form of a pylon) arranged along the route. The function of the pylons 5 arranged between the terminal stations, and optionally between the intermediate stations, is to support and divide the cable 2 into spans. Although both the transportation unit 4 and the pylon 5 will be the subject of the description of FIGS. 2 and 3, in FIG. 1 it is already possible to appreciate that the transportation unit 4 of the example shown comprises a gondola 6 at the bottom and a support arm 7 (called suspension) at the top which connects it to the cable 2. As shown in FIG. 2, the gondolas 6 (at least in the section outside the stations) are suspended in mid-air, not resting at the bottom on any lower structure, and therefore, by virtue of being constrained at the top to the cable 2, can be subjected to rolling movements around the axis of the cable 2, for example due to the effect of lateral wind, as well as to longitudinal pitch movements. Reference number 8 in FIG. 1 schematically shows the device connecting the support arm 7 to the cable 2. This device may comprise a releasable clamp. Finally, FIG. 1 shows that the pylon 5 comprises a vertical portion 9 at the top of which there is a row of rollers 10 supporting the cable 2.

FIG. 2 shows a schematic view of the component indicated as II in FIG. 1 (i.e., a transportation unit 4 comprising a corresponding gondola 6). In particular, FIG. 2 shows a front view of the unit 4 along the axis of the cable 2. As can be seen, the unit 4 comprises a gondola 6 provided with a floor or bottom 11, a roof 12, and side walls 13. On one side of the side walls 13 there is a movable door (not shown in the drawings), a footboard 14 to assist the entry and exit of the passengers, and pockets 15 in which objects such as skis 16, ski sticks, or other things can be placed. The unit 4 further comprises a support arm 7 (called suspension) having a first lower end 17 coupled to the roof 12 of the gondola 6, by an intermediate frame, and an upper end 18 provided with a clamp 19 configured to releasably couple to the cable 2. The clamping mechanism comprises a spring 20 and an actuating lever 21 which, in the station, by specially shaped guides, is moved to overcome the force of the spring 20 and release the cable 2 from the clamp 19. As can be seen, the bottom 11 of the gondola 6, as it does not rest on any guiding or supporting structure, is suspended in mid-air, and therefore, due to the constraint to the cable 2 placed above the roof 12, the gondola 6 can perform oscillations (for example, roll oscillations schematised with R in FIG. 2 about the axis defined by the cable 2). In particular, this roll R can be generated by the presence of a lateral force (schematised with F in FIG. 2), for example due to the presence of wind. It is therefore possible that in some circumstances the gondola 6 is in a tilted position, thus occupying a greater lateral volume than the encumbrance shown in FIG. 1 where there is no lateral force F. The embodiment shown in which the transportation unit is in the form of a gondola is a non-limiting example only.

Figure 3:
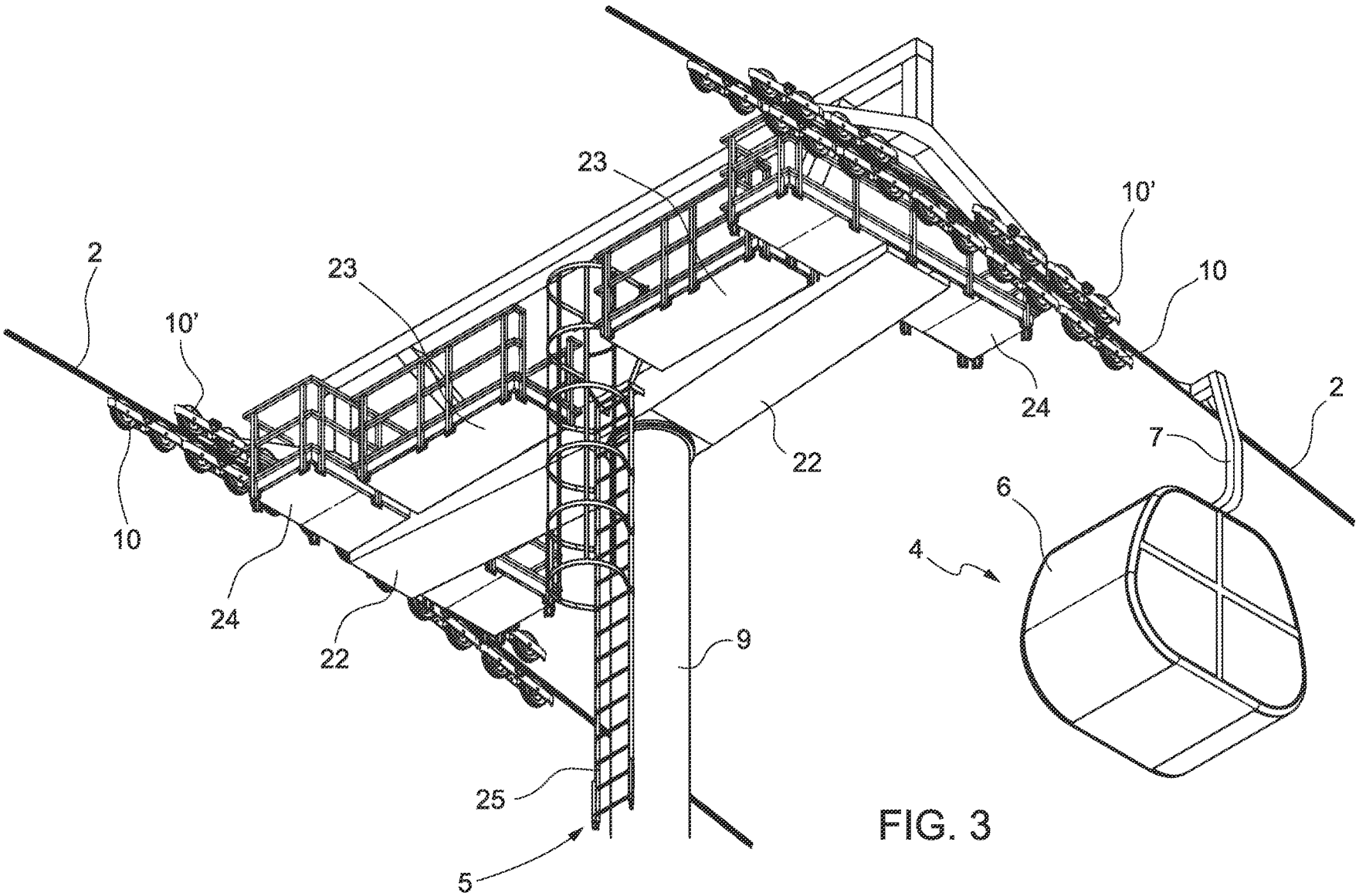
FIG. 3 is a schematic view of the component indicated as III in FIG. 1 (i.e., an intermediate fixed structure supporting the cable, in the form of a vertical pylon)

FIG. 3 shows a schematic view of the component indicated as III in FIG. 1 (i.e., an intermediate fixed structure 5 supporting the cable 2). In particular, FIG. 3 substantially shows the upper half of said pylon 5 and makes it possible to appreciate that the rollers 10, mentioned above, are supported by said structure 5. The upper end of the pylon 5 comprises two support bracket structures 22 which, in a cantilever fashion, extend symmetrically with respect to the pylon 5. Each outer end of said brackets 22 supports two rows of rollers 10, 10' superimposed on each other so as to provide a passage for the upward and downward branches of the cable 2. These brackets 22 further comprise a walkway 23 and a platform 24 to enable inspection of the rollers 10, 10'. Said walkway 23 and platform 24 can be accessed, for example, by a ladder 25 running along the pylon 5. FIG. 3 shows a representation in which no lateral wind acts against the gondolas 6, which are in a non-tilted position. However, as described with reference to FIG. 2, with a lateral wind F, the gondolas 6 roll about the axis of the cable 2 and can also exceed a limit tilt angle at which they collide with the lower wall of the platform 24 or generally with parts of the pylon. In this condition, it may happen that the gondola gets stuck against the pylon and thus cannot advance. At this point, the cable slides in the clamp (which is allowed for safety reasons) and continues to advance. In this way, a gondola upstream of the blocked one is advanced dangerously toward the blocked one, creating rear-end collisions and an extremely dangerous situation. Such a scenario does not necessarily occur at the pylons but can also occur in an external section between the pylons or between a pylon and a station. For example, a tree could fall, and its branches get entangled with the cable, thereby blocking the gondola and reproducing the dangerous scenario described above. Hitches or slowdowns may also occur in the case of strong longitudinal wind, which can lead to pitch movements of the transportation units, such that they impact with adjacent structures, slowing down or blocking their advance. Similar hitches can also occur with units provided with trolleys configured to couple to supporting cables or with units moved by motorized trolleys in the absence of a hauling cable.

Figure 4A:
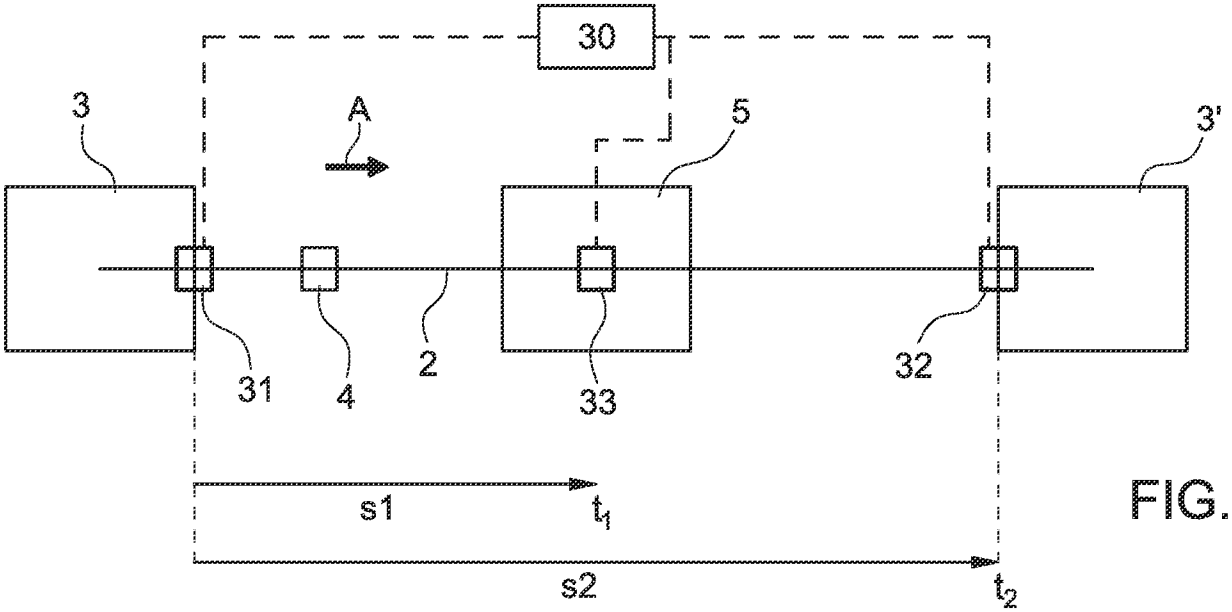
FIG. 4A shows a first example of a system according to the present disclosure.
Figure 4B:
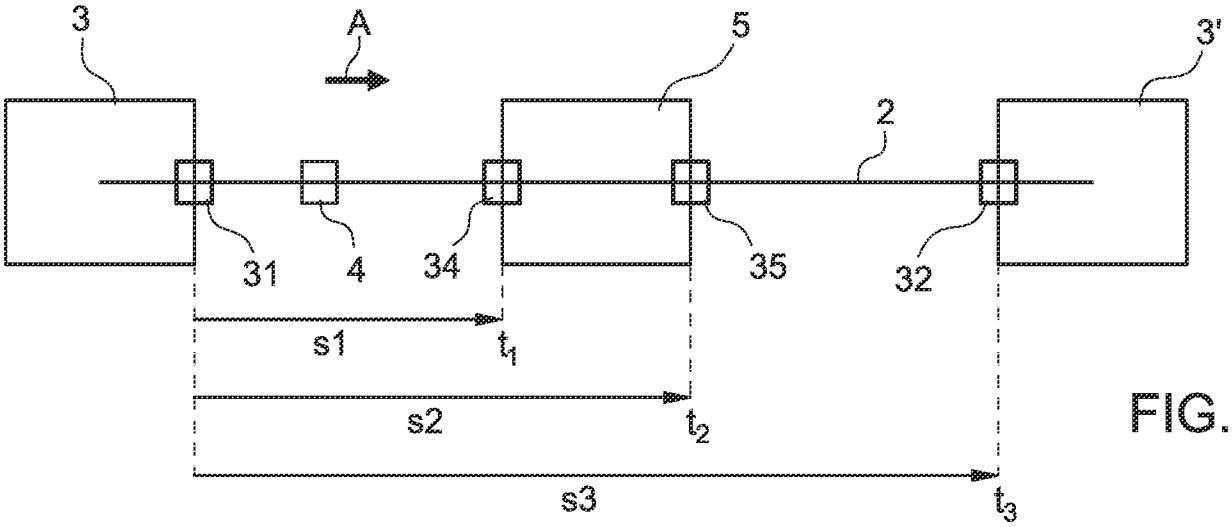
FIG. 4B shows a second example of a system according to the present disclosure.
Figure 5:
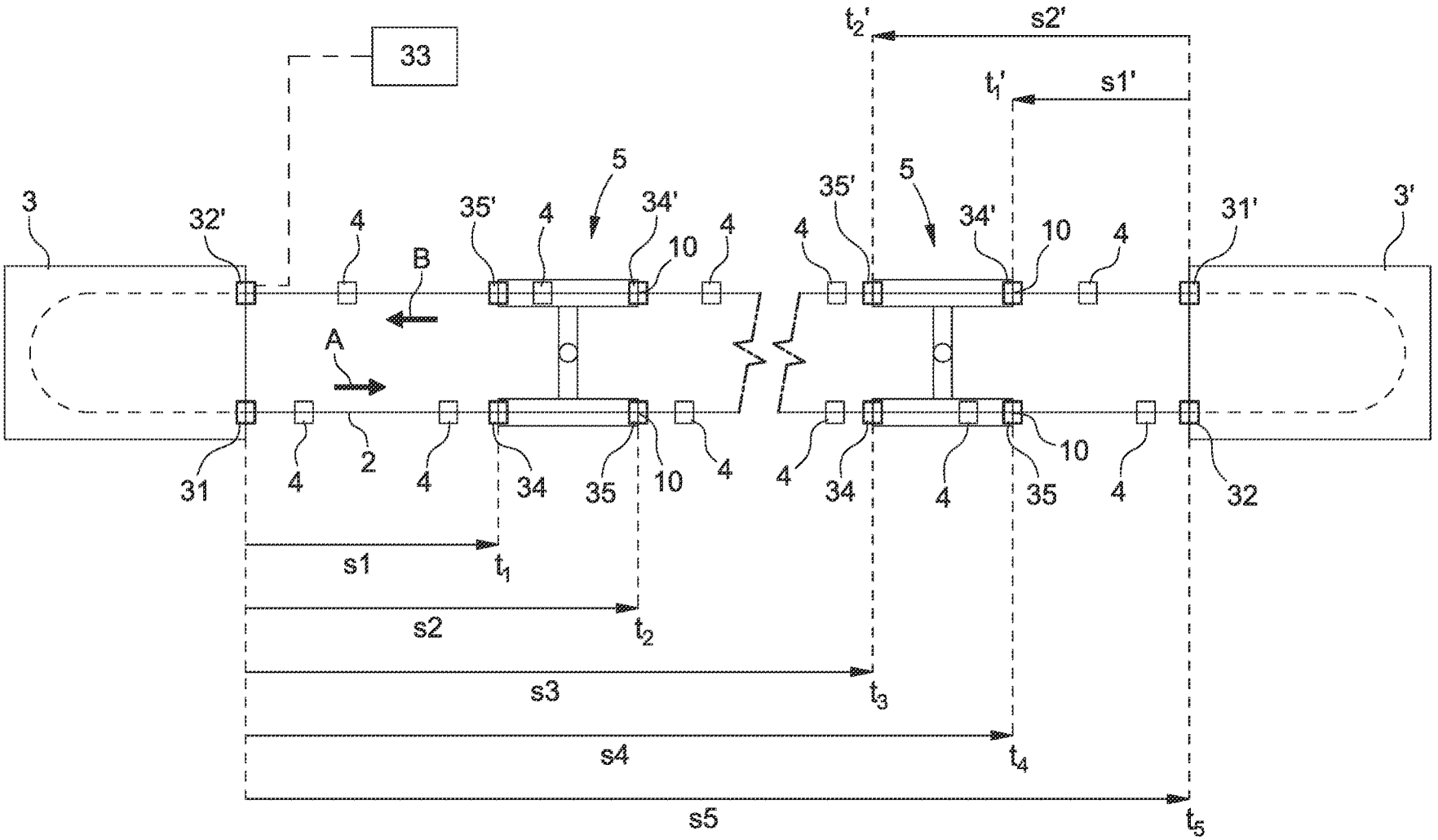
FIG. 5 is a schematic view of a third system according to the present disclosure.

FIGS. 4A and 4B show schematic views of two possible systems (in a relatively very simplified form) according to the present disclosure, identifying the devices provided along the route and the division thereof into intermediate check points or finish lines. FIG. 5 shows a system, still in a relatively simplified, although more complete form. The object of the present disclosure is that any blocking or slowing down of a transportation unit along the route between the terminal stations, either at the pylons or in the section between two adjacent pylons or between a pylon and an adjacent terminal station, is readily signalled. FIG. 4A schematizes a system in which some elements are omitted to only show the elements necessary for a correct understanding of the disclosure. Therefore, FIG. 4A shows the bottom station 3 or first terminal station acting as the first fixed structure, the top station 3' or second terminal station, a pylon 5 located between the stations acting as an intermediate structure, a hauling and supporting cable 2 (single-cable system) running between the stations and along the pylon 5, and a transportation unit 4 exiting the bottom station 3 and travelling towards the pylon 5. In FIG. 4A, the arrow A represents the direction of motion of the unit 4, the reference number 30 represents a control unit, and the reference numbers 31, 32 and 33 represent sensors arranged at suitable points on the track and configured to detect the passage of the transportation unit 4. Sensors capable of performing this operation may be, for example, capacitive sensors which interact with the clamp connecting the transportation unit to the cable 2. Generally, according to the disclosure, an exit terminal sensor 31 acting as the first sensor is arranged in the exit area of the bottom station 3. An entry terminal sensor 32 acting as the second sensor is arranged in the entry area of the top station 3. An intermediate sensor 33 acting as the second sensor is finally arranged at the intermediate structure 5. The control unit 30 is connected to the sensors and configured as follows. When the unit 4 passes by the exit terminal sensor 31, the latter transmits this information to the control unit, which is provided with a counter capable of counting the cable meters that are subsequently fed outside the top station 3. Since the distances s1 and s2 (in terms of cable-meters) are known, when the cable meters fed outside the top station 3 substantially correspond (i.e., with a tolerance interval) to these distances s1 and s2, the control unit expects to receive from the corresponding sensors 32, 33 the indication that the unit 4 has passed. Additionally, or alternatively, the control unit may be provided with a time calculation device configured to calculate, as a function of the speed of the cable 2 and of the cable meters separating the sensors (distances s1 and s2), two theoretical time limits or split times t1 t2 at which the transportation unit should reach the established finish lines (i.e., pass by the at least one intermediate sensor 33 and the entry sensor 32). The control unit then starts counting the cable meters and/or starts a timer or time counter and waits to receive the signal that the unit has passed by the intermediate sensor 33. If the passage of the transportation unit 4 by the intermediate sensor is not detected upon the feeding of an amount of cable meters equal to s1 or in the calculated split time t1, the control unit carries out safety actions and, if necessary, emits an alarm signal. Instead, if the passage of the transportation unit 4 by the intermediate sensor 33 is detected as estimated, no alarm is emitted, and the system continues its normal operation. In this scenario, there is the certainty that in the section of the system upstream of the intermediate sensor 33 there are no reasons of danger for the passengers which could slow down or block the transportation unit. In this case, once the intermediate sensor 33 has been passed, the control unit waits to receive the next signal indicating that the unit has passed by the entry terminal sensor 32 and expects to receive it at the calculated split time t2 when the unit 4 has exited the first terminal station or upon counting an amount of cable meters delivered equal to the distance s2. Therefore, excessive delay or non-arrival of the unit at the station 3' would indicate a problem in the line between the terminal sensor 32 and the intermediate sensor 33. As it appears, therefore, the present disclosure divides the route into a plurality of sections in which each section is delimited by a sensor at which it is checked whether the transportation unit advances as expected, starting from the passage by the exit terminal sensor 31. As stated above, the system in FIG. 4A is relatively very simple and schematic and can represent a "back-and-forth" system (therefore the entry and exit areas in the station coincide and the same terminal sensor acts as the entry and exit sensor depending on the direction of advance) or can represent one of the two directions of travel of a system with U stations with two parallel runways, as shown in FIG. 5. Before moving on to the next figure, it is emphasized that the present disclosure also relates to systems without intermediate structures (i.e., only comprising the terminal stations as the fixed structures). Finally, in FIG. 4A, the intermediate sensor 33 is shown arranged in a central position along the pylon. However, certain embodiments provides said intermediate sensor 33 is arranged in an exit area of the pylon.

FIG. 4B shows a first variant of the system in FIG. 4A. The only difference compared to the above-described system is that at the intermediate structure 5 there is not a single sensor but a pair of sensors 34 35, respectively, in the entry and exit areas of said structure 5, so as to identify a specific check area right along the section defined by the structure 5. The checking logic is the same (i.e., when the unit 4 passes by the exit terminal sensor 31), the control unit starts counting the delivered cable meters or, on the basis of the speed of the cable 2 and the cable-meter length s1, s2, s3 between the sensors, calculates estimated arrival times t1, t2 and t3 (understood as time intervals starting from the instant t0) in which the unit 4 should pass by the sensors 34, 35 and 32, respectively. If these sensors do not detect the passage upon delivery of an amount of cable meters about equal to the cable distances s1, s2, s3 and/or within a maximum time delay (or advance) threshold with respect to the times t1, t2 and t3, the control unit will activate to secure the system.

FIG. 5 shows a schematic view of a system with two opposite and parallel runways A and B, two terminal stations in which the units 4 are looped into a U-shape, and for each branch, a plurality of intermediate structures 5 as shown in FIG. 4B, (i.e., each intermediate structure, is provided with an intermediate entry sensor 34 and an intermediate exit sensor 35). The numerical references provided on the branch B are the same with apexes used for the branch A to show that the checking logic does not change. For each branch A or B, the control unit 33 is notified of the exit from the station 3 or 3' of a unit 4 and from that moment, as before, it starts to measure the cable meters exiting the station and/or calculates the theoretical arrival split times t1, t1', t2, t2' to in which that unit should progressively pass by the sensors 34, 35, 32, 34', 35', 32'. As in the previous cases, if the sensors do not detect the passage when the cable meters delivered are about equal to the distances s1 s2 s3 s4 s5 and/or within a maximum time delay threshold with respect to the estimated arrival time, the control unit will activate to secure the system. It should be appreciated that the logics of checking the delivered cable meters and the split times can be applied alternatively or additionally to systems provided with a hauling cable. In systems without a hauling cable and equipped with motorized trolleys, only the split-time logic would be applied. However, both cases are examples of the application of identifying on the path some finish lines and check whether the units pass by such finish lines based on a (spatial or temporal) reference defined starting from the exit of the unit from the terminal station.

In this last example, which may represent a considerably lengthy system, as in other systems, several "first sensors" (i.e., several starting check or monitoring points) and several corresponding fixed structures, which act as first structures for said first sensors, can be provided. The concept of "starting point" of the check can also be generalized and shifted to an intermediate position of the system. In this respect, a pylon can also act as a first fixed structure and the system is divided into two or more divided check portions (i.e., a first portion between the first terminal station (with a first sensor) and said pylon, which acts as a first fixed structure with a corresponding first sensor for at least a second portion between said pylon and the second terminal station. In the latter case, the same sensor can act both as a second sensor for the upstream check section and as a first sensor for the downstream check section).

Lastly, it is clear that modifications and variations may be made to the disclosure described herein without departing from the scope of the appended claims. That is, the present disclosure also covers embodiments that are not described in the detailed description above as well as equivalent embodiments that are part of the scope of protection set forth in the claims. Accordingly, various changes and modifications to the presently disclosed embodiments will be apparent to those skilled in the art.

The invention claimed is:

1. An aerial cable transportation system comprising:
- a hauling cable;
- a first fixed structure;
- a transportation unit;
- a plurality of sensors comprising at least a first sensor arranged at an exit area of the first fixed structure and a second sensor arranged downstream of the first sensor at a distance from the first sensor measured in cable-meters; and
- a control unit connected to the sensors and configured to:
  - responsive to a passage of the transportation unit being detected by the first sensor, start to count a quantity of meters of hauling cable fed outside the first fixed structure, and
  - when the counting of the quantity of meters of hauling cable fed outside the first fixed structure reaches a quantity of meters associated with the distance between the first sensor and the second sensor, autonomously activate a safety procedure if the passage of the transportation unit is not detected by the second sensor downstream of the first sensor.

2. The aerial cable transportation system of claim 1, wherein the first fixed structure comprises any of a terminal station, a pylon, and an intermediate station.

3. The aerial cable transportation system of claim 2, wherein the first fixed structure comprises a first terminal station and the aerial cable transportation system further comprises a second terminal station including a second entry terminal sensor arranged at an entry area of the second terminal station.

4. The aerial cable transportation system of claim 3, further comprising an intermediate structure between the first terminal station and the second terminal station, wherein the second sensor is arranged at the intermediate structure.

5. The aerial cable transportation system of claim 4, wherein the intermediate structure comprises an entry zone and an exit zone for the transportation unit, the second sensor being arranged at the exit zone.

6. The aerial cable transportation system of claim 4, wherein the intermediate structure comprises an entry zone and an exit zone for the transportation unit, a first second sensor is arranged at the entry zone of the intermediate structure and a second second sensor is arranged at the exit zone of the intermediate structure.

7. The aerial cable transportation system of claim 3, wherein the intermediate structure is any of an intermediate station and a pylon configured to support the hauling cable.

8. The aerial cable transportation system of claim 2, wherein:

the terminal station comprises a U station associated with two opposite directions of travel of the transportation unit, the U station comprising an entry terminal sensor and an exit terminal sensor, and the intermediate structure comprises, for each direction of travel, an entry sensor and an exit sensor.

9. A method for operating an aerial cable transportation system, the method comprising:

responsive to a passage of a transportation unit detected by a first sensor arranged at an exit area of a first fixed structure, starting to measure, by a control unit, how many meters of a hauling cable are fed outside the first fixed structure; and when the measurement of meters of hauling cable fed outside the first fixed structure reaches an amount associated with a distance, measured in cable-meters, that a second sensor is arranged downstream from the first sensor, autonomously activating, by the control unit, a safety procedure if the passage of the transportation unit is not detected by the second sensor downstream of the first sensor.

10. The method of claim 9, wherein the first fixed structure comprises any of a terminal station, a pylon, and an intermediate station.

11. The method of claim 10, wherein the first fixed structure comprises a first terminal station and the aerial cable transportation system includes a second terminal station including a second entry terminal sensor arranged at an entry area of the second terminal station.

12. The method of claim 11, wherein an intermediate structure is between the first terminal station and the second terminal station, wherein the second sensor is arranged at the intermediate structure.

13. The method of claim 12, wherein the intermediate structure comprises an entry zone and an exit zone for the transportation unit, the second sensor being arranged at the exit zone.

14. The method of claim 12, wherein the intermediate structure comprises an entry zone and an exit zone for the transportation unit, a first second sensor is arranged at the entry zone of the intermediate structure and a second second sensor is arranged at the exit zone of the intermediate structure.

15. The method of claim 11, wherein the intermediate structure is any of an intermediate station and a pylon configured to support the hauling cable.

16. The method of claim 10, wherein:

the terminal station comprises a U station associated with two opposite directions of travel of the transportation unit, the U station comprising an entry terminal sensor and an exit terminal sensor, and the intermediate structure comprises, for each direction of travel, an entry sensor and an exit sensor.

17. A method for operating an aerial cable transportation system, the method comprising:

responsive to an exit of a transportation unit from a first fixed structure, calculating a theoretical split time of when the transportation unit should pass a finish line downstream of the first fixed structure, the calculation being based on a distance of the finish line from the first fixed structure and a theoretical speed of the transport unit; and activating a safety procedure if a passage of the transportation unit at the finish line does not occur within a pre-set range relative to the calculated theoretical split time of when the transportation unit should pass the finish line.

* * * * *